United States Patent [19]

Tschudy

[11] 4,182,618

[45] Jan. 8, 1980

[54] FASTENING ARRANGEMENT FOR UPPER FILL TUBE ON A SOFT BAG CLEANER

[75] Inventor: Donald B. Tschudy, Canton, Ohio

[73] Assignee: The Hoover Company, North Canton, Ohio

[21] Appl. No.: 897,445

[22] Filed: Apr. 18, 1978

[51] Int. Cl.[2] ..... B01D 46/02

[52] U.S. Cl. ..... 55/374; 15/351; 55/378; 55/473

[58] Field of Search ..... 55/374–379, 55/473; 15/351, 410; 248/100, 101

[56] References Cited

U.S. PATENT DOCUMENTS

| | | | |
|---|---|---|---|
| 1,989,868 | 2/1935 | Kessler | 55/374 |
| 2,176,467 | 10/1939 | Milner, Jr. et al. | 55/374 |
| 2,610,702 | 9/1952 | Thornwald | 55/374 |
| 3,163,439 | 12/1964 | Huston et al. | 15/351 |
| 3,308,247 | 3/1967 | Doersam et al. | 55/473 |
| 3,618,687 | 11/1971 | Ripple et al. | 15/410 |
| 3,636,584 | 1/1972 | MacFarland | 55/410 |

*Primary Examiner*—Bernard Nozick

[57] ABSTRACT

A floor care appliance is described in which a rigid housing may extend upwardly from the appliance nozzle. The rigid housing may mount a reel therein or may just serve as an appearance housing for the floor care appliance. In either case, the rear of the housing mounts a rigid plate that extends upwardly from it. An upper fill tube has its upper end attached to this plate. The cloth bag for the floor care appliance extends around the fill tube and is mounted to the housing, intermediate its upper and lower ends, by the rigid plate. The cloth bag thereby encapsulates the rigid plate and fill tube so as to provide a pleasing outside appearance to the floor care appliance.

5 Claims, 5 Drawing Figures

FASTENING ARRANGEMENT FOR UPPER FILL TUBE ON A SOFT BAG CLEANER

BACKGROUND OF THE INVENTION

1. Field of the Invention

This invention relates to floor care appliances and, more specifically, relates to a rigid housing soft bag upright cleaner utilizing an upper fill concept.

2. Description of the Prior Art

The use of upper fill tubes is broadly old in floor care appliances, many configurations being utilized in the prior art to provide an upper fill function to take advantage of the fact that dirt deposited in the dirt collecting bag in these arrangements does not provide the equivalent of a pressure head or plug against which the fan-motor arrangement must work as cleaning progresses further.

These configurations include tubes fastened to the inside of hard or soft dirt collecting bags, tubes fastened to handle arrangements and exhausting into a bag structure and tubes actually coincident with a handle that supports and fluently communicates with the dirt collecting bag (normally a soft bag).

At the same time, floor care appliances having rigid housings, desirably, only for the storage of reels and the nesting of motor-fan units or the like are also known in the floor care art but these, heretofore, have not been combined with an upper fill configuration so that the advantages of both a rigid non air bag receiving housing arrangement and an upper fill tube could be melded into a single, unitary cooperating structure.

It would, therefore, be advantageous to provide an upper fill tube arrangement that directly cooperates with a non dirt collecting hard bag housing that, therefore, could also be utilized to house a reel or the like.

It would also be advantageous to utilize the rigid housing to provide an intermediate supporting network for the top fill duct.

It would be even more advantageous to provide a mounting plate for the upper fill tube so that the floor appliance handle was independent of it and could be easily removed from connection with the hard bag housing.

It would be still a further advantage to mount the top fill tube upwardly from the mounting plate attached to the rigid housing.

It would be additionally advantageous to mask the fill tube and support plate, to hide them from view, by some convenient arrangement.

It would be still more advantageous to utilize the soft bag of the floor care appliance for such a purpose.

It would be even more advantageous if the mounting plate utilized for top fill tube supporting purposes was also used as the housing connecting arrangement for the soft bag, especially if the bag was trapped behind the mounting plate to obscure and cover the same to provide a pleasing appearance for the floor care appliance or cleaner.

SUMMARY OF THE INVENTION

The invention comprises a hard housing and handle arrangement for an upright cleaner or the like. The hard housing may contain a motor-fan unit and a cord reel or the like and extends upwardly from a main casting or nozzle (neither shown) to serve as a portion of the handle. A conventional shortened handle is attached to upper portions of this rigid housing to provide a reasonably easy graspable means for use of the operator of this cleaner.

Attached to the back side of the rigid housing is mounted a mounting plate for support of the rigid, upper fill tube. This mounting plate includes integral latches which lockingly hold the upper end of the fill tube in a removable manner so that the same can be disassembled from the rigid housing and mounting plate for clean out purposes. The fill tube is connected at its bottom to an intermediate plate for the rigid housing to confluently communicate with the fan of the fan-motor system.

The soft bag for the appliance is conventionally attached to a hanger arrangement at its upper end and attached at its bottom to the rigid housing so as to be suspended therebetween on the rear side of the rigid housing. Intermediate its ends, the bag is held captive to the back of the rigid housing by the mounting plate for the upper fill tube. The bag is made to wrap behind this member so that the mounting plate and tube become encapsulated by it and so that a rigid housing-soft bag cleaner having upper fill characteristics is provided of effective nature and having a fine appearance that lends marketability to it for the mass consumer market.

BRIEF DESCRIPTION OF THE DRAWINGS

Reference may now be had to the accompanying drawings for a better understanding of the invention, both as to its organization and function, with the illustration being only exemplary, and in which.

DETAILED DESCRIPTION OF THE INVENTION

Figure 1:
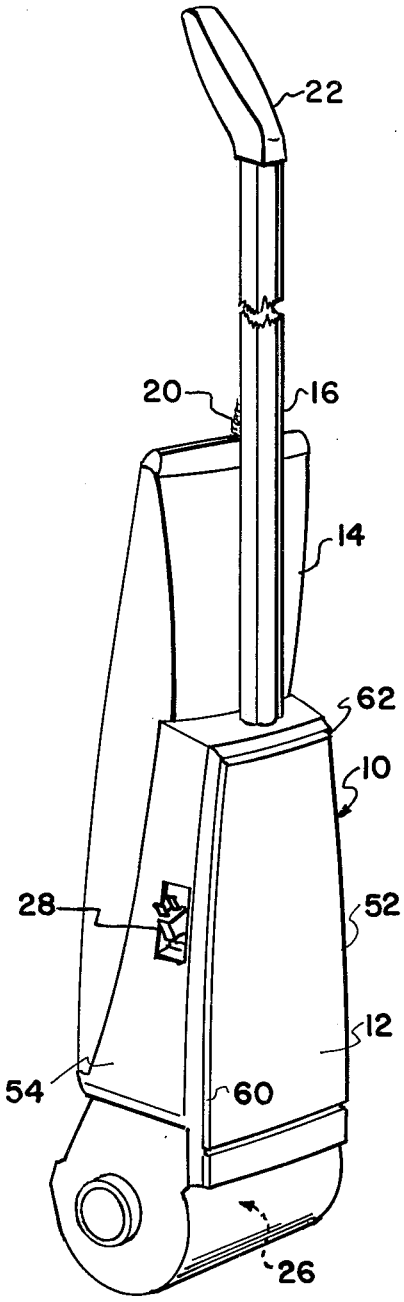
FIG. 1 is a perspective view of a rigid housing-soft bag portion of a cleaner incorporating the invention.
Figure 2:
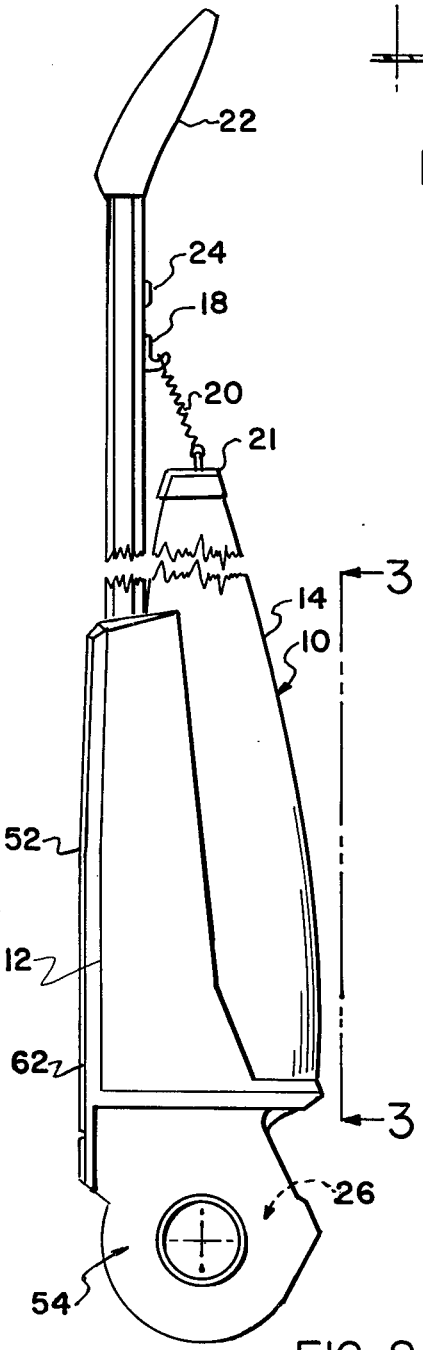
FIG. 2 is a side view of the same apparatus.

As can be seen most clearly in FIGS. 1 and 2 an upper part 10 of a cleaner is illustrated including a rigid housing 12, situated at its lower end, a soft bag 14 extending upwardly therefrom and a handle 16 attached to the rigid housing 12. A bag hook 18 is attached to the handle 16 for bag support through a bag supporting spring 20. An upper bag cap 21 clampingly provides for easy connection to bag supporting spring 20. A hand grip 22 caps the upper end of the handle 16 which also includes a switch 24 for actuation of a fan-motor system 26. An electric plug 28 is included with upper portion 10 for connection to a convenient outlet (not shown) situated in the area to undergo cleaning.

The lower portion of the cleaner (not shown) may be of a generally conventional nature and may, for example, be closely akin to the nozzle or main casting configuration shown in U.S. Pat. No. 3,581,591, issued June 1, 1971, and owned by a common assignee. In view of the disclosure in this patent no further description of such a bottom portion of a cleaner is deemed necessary.

Turning now to the remaining figures in the Drawings, handle 16 is seen as generally rectangular in cross section and extending downwardly to be removably situated into a socket 34 formed in rigid housing 12, this socket being formed by a series of ribs (unnumbered). A pair of handle holding parts 36, 38 form a tubular insert, generally rectangular in configuration, inserted to nest within bottom portions of the handle 16, the same being telescoped over a cup shaped member 40 attached to rigid housing 12 so as to be slightly pivotable relative to the confines of the socket 34. The handle holding parts 36, 38, then, telescope over this member so that it provides general alignment for them.

Punched and threaded holes 42, 42 are formed in holding part 38 to permit the passage of screws 44, 44 which bear against handle holding part 36 when screwed into threaded holes 42, 42. The wedging action of screws 44, 44, as they screwingly abut the holding part 36, separate it from holding part 38 and holding part 38 from it. These two pieces thereby compressingly expand and engage against a lower portion 45 of the handle 16. Handle 16 includes a pair of splits (not shown) in this lower portion so that the handle 16 is capable of expanding deformation and it does so under the imposition of expanding forces from the holding parts 36, 38 so as to bear against the periphery of socket 34. A rivet 43 also maintains holding parts 36 and 38 in selected position in housing 12.

The general handle holding configuration just reviewed is quite similar to that shown and described in copending U.S. application Ser. No. 862,011 filed Dec. 19, 1977, titled "Separable Handle for a Cleaner" and owned by a common assignee.

Disposed below the handle connection, is a reel 50 which is non-rotatably journalled at pilot bore 51 in a front cover piece 52 that extends upwardly and sidewardly for nearly the full extent of the front of the rigid housing 12. It is also non-rotatably journalled at pilot bore 53 in a molded main housing section 54 that serves as the main structural member for rigid housing 12.

The front cover piece 52 fits against a ledge 60 (partially shown) formed in and extending around the top and sides of the main housing section 54 so that the front cover piece 52 fits into and is generally flush with an angled border 62 formed by the front edge of the main housing section 54. Any conventional fastening means may secure these two members together although integral slots and latching shoulders may desirably be used.

Disposed below reel 50, main housing section 54 includes an integral motor housing section 70 of generally semi-cylindrical form that encapsulates the motor-fan system 26 and forms a portion of the pivotal mounting (not shown) of the upper section 10 with the nozzle or main casting (not shown). A rear generally semi-cylindrical housing section 72 mates with motor housing section 70 to complete the enclosure for the fan-motor system 26. Screws (not shown) fixedly mount these two sections together through thickened sections not apparent in the Drawings.

A rear upper portion 76 of rear housing section 72 extends outwardly from its cylindrical periphery and then upwardly to form a rim or border 78 that includes a horizontal flange 80. Inwardly of the end terminations of horizontal flange 80, main housing section 54 includes a generally horizontal ledge 82 that extends around in a general semi-circle to provide, with horizontal flange 80, a closed horizontally extending cylindrical flange wall utilized for bag securement purposes.

A cap member 84 is mounted over this flange wall, the same having a general cup shape so as to fit downwardly within the upwardly opening formed by the rear portion 76 of rear semi-cylindrical housing section 72 and the outward formation of the main housing section 54, slightly above the termination of motor housing section 70.

This cap member includes an integral, upwardly extending rim 86 adjacent its outer border which merges into an integral, short, horizontally extending section 88 that, in turn, merges with a downwardly extending flange 90 which serves as the outer bordering rim for the cap member 84.

Figure 4:
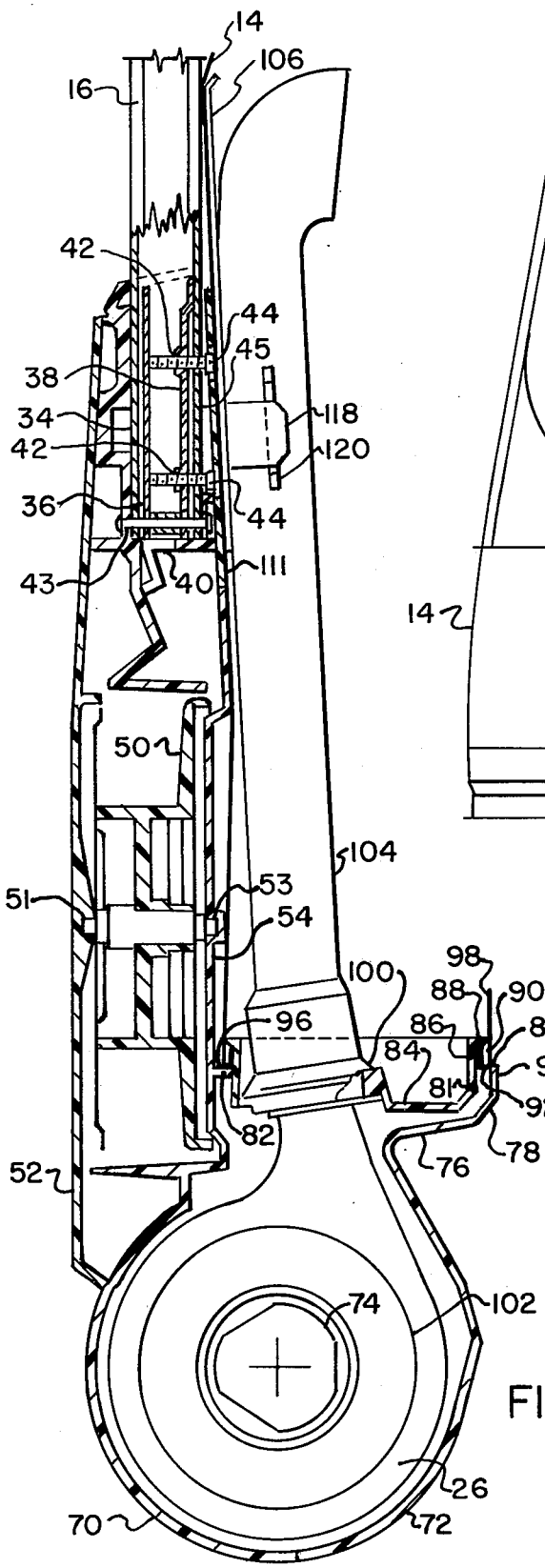
FIG. 4 is a partial cross sectional view of the apparatus of FIG. 2 taken on a plane transverse to that of line 3—3.
Figure 3:
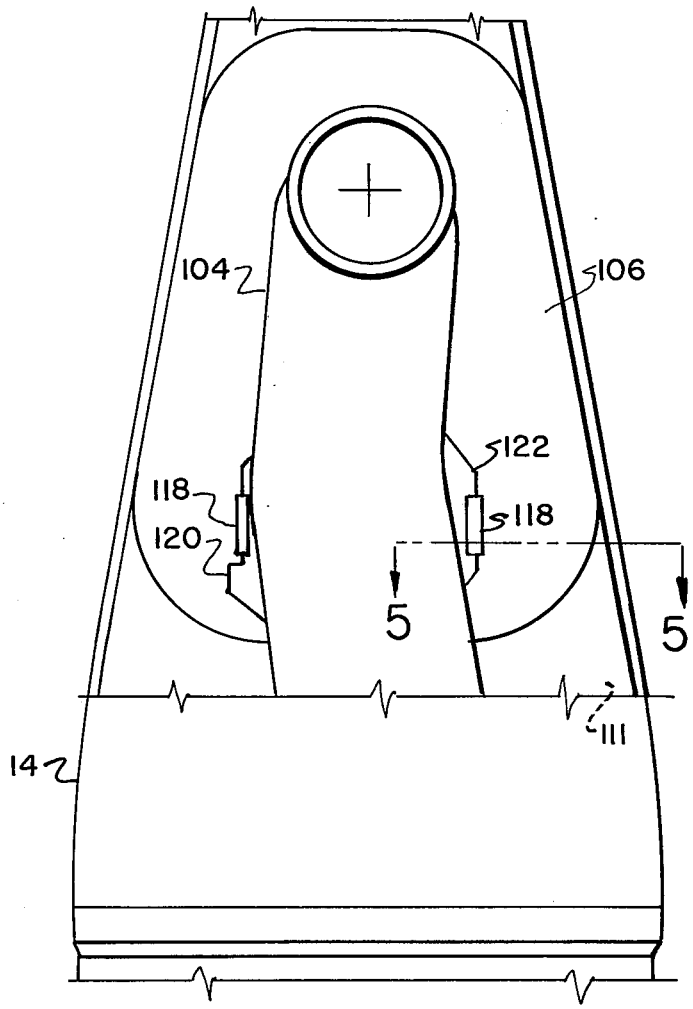
FIG. 3 is a partial cross sectional view of the apparatus of FIG. 2 taken on line 3—3 of FIG. 2 but shown with the bag schematically and partly removed.

With the cap member 84 mounted on the main housing section 54 and rear upper portion 76 of rear motor housing section 72, a downward terminating end 92 of it, is disposed adjacent an upward terminating end 94 of rear upper portion 76 and an upper side 96 of horizontal ledge 82. By this arrangement a lower end 98 of soft bag 14 is captured (fragmentarily seen in FIG. 4) to mount the lower end of it with the upper part 10 of the cleaner.

In this position, the soft bag 14 through its lower end 98, covers a duct coupling means 100 extending upwardly from a cap member 84. This duct coupling means 100, in turn, mounts the lower end of an upper fill duct or tube 104 in telescopic relation over it so that upper fill duct 104 confluently communicates with motor fan compartment 102. Soft bag 14 extends upwardly from its lower end 98 to envelope the duct 104 as it extends upwardly, with the bag 14 disposed between the duct 104 and the rigid housing 12.

Adjacent the upper end of rigid housing 12, main housing section 54 carries an upper fill tube mounting plate 106 which mounts thereagainst and has the soft bag 14 disposed between them so it receives retentive support from the upper fill tube mounting plate. Thus, the soft bag 14 is mounted medially by mounting plate 106, at its lower reaches by rigid housing 12 through cap member 84 and at its upper reaches by bag cap 21. Thus, the bag 14 lies against the back side of rigid housing 12 to obscure it and encapsulate upper fill tube 104 and mounting plate 106 within it.

Figure 5:
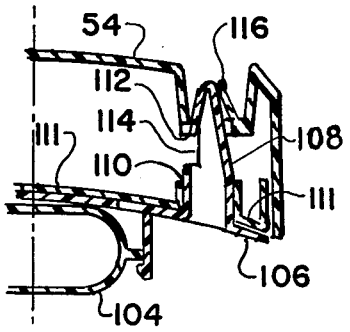
FIG. 5 is a fragmentary sectional view of the mounting plate rigid housing connection taken on line 5—5 of FIG. 3 with the tang apertured bag portion deleted.

The securing arrangement for the upper fill tube mounting plate 106 can best be seen in FIG. 5. The mounting plate 106 includes a pair of tapered projections 108 (only one shown) on each side of the upper fill tube 104 that extend through apertures 110 (only one shown) in a back plate 111 at this location. The housing section 54 includes a hooked portion 112 that enters an aperture 114 in tapered projection 108 to maintain the mounting plate 106 attached to main housing section 54. A resilient tab 116 on main housing section 54 at all times tends to urge the projection 108 toward engagement with hooked portion 112 to thereby aid in securing the mounting of plate 106 with main housing section 54. In order to prevent interference between the soft bag 14 and projections 108 in this area, the bag 14 includes apertures (not shown) for the passage of projections 108. This arrangement insures firm retention of the mounting plate 106 by the main housing section 54 and secure capture of the bag 14 behind the mounting plate 106 and between it and the main housing section 54.

Back plate 111, just referred to, is attached to the housing section 54 so as to be substantially parallel to its major extent, spaced by ribs or the like from this extent and attached to it by conventional means (not shown). It extends to the top of housing section 54 and terminates slightly below the upper fill tube mounting plate 106.

Mounting plate 106 also serves as the retention means for upper fill duct 104. Included integrally with this plate are a pair of shouldered latch members 118, 118 that resiliently engage over a pair of sidewardly extending tabs 120, 122 (inboard of tapered projections 108) made integral with upper fill duct 104. In order to mount the duct 104 with the main housing section 54, the lower end of it is telescoped over duct coupling means 100 and the upper end of it pushed towards the upper fill tube mounting plate, springing latching members 118, 118 outwardly so that their shouldered portions (unnumbered) engage over tabs 120, 122. A secure mount is arrived at thereby.

At the upper end of upper fill tube mounting plate 106, it can be seen (FIG. 4) that the bag 14 passes behind it and between it and the handle 16 so as to be easily supported by bag cap 21 (FIG. 2) and to, again, obscure the full width and height of upper fill tube mounting plate 106, the mounting plate being elongated heightwise to receive and abuttingly support the upper fill tube 104 above the tapered projections 108.

It should be clear that the objects of the invention set out in the beginning portion of the description have been fully met. It should also be clear that many modifications to the invention described would obviously occur to one skilled in the art and that these modifications would still fall within the spirit and purview of the description offered.

What is claimed is:

1. In a floor care appliance having an upper portion including an upstanding handle and rigid housing, (a) said rigid housing being disposed at the lower part of said upper portion and at its bottom having an enlarged portion sized to contain a motor-fan unit for creating air movement through said floor care appliance, (b) a soft, porous bag attached at its bottom to a lower portion of said rigid housing above said motor-fan unit and communicating with said motor-fan unit and forming a dirt-receiving cavity and extending upwardly above said rigid housing, (c) a mounting plate attached to said rigid housing adjacent its upper termination, (d) said soft, porous bag extending between said rigid housing and said mounting plate and being attached to said rigid housing by said mounting plate to surround the mounting plate and to lie against the contiguous side of said rigid housing, and (e) said handle serving as means for grasping by an operator and attached to said rigid housing and extending upwardly therefrom.

2. In the floor care appliance upper portion as set out in claim 1, wherein;

(a) said soft, porous bag closely abuts against said rigid housing at said mounting plate.

3. In the floor care appliance upper portion as set out in claim 1, wherein;

(a) said mounting plate and said rigid housing include integral apertures and shouldered portions for fastening said mounting plate to said rigid housing.

4. In the floor care appliance upper portion as set out in claim 1, wherein;

(a) an upper fill tube is attached to said mounting plate for support, said fill tube providing an opening in upper reaches of said soft, porous bag.

5. In a floor care appliance upper portion as set out in claim 4, wherein;

(a) said mounting plate and said fill tube include integral means for latching said fill tube to said mounting plate.

* * * * *